United States Patent [19]

Santarossa

[11] Patent Number: 4,887,374

[45] Date of Patent: Dec. 19, 1989

[54] RECOIL PAD FOR RIFLE

[76] Inventor: Mario Santarossa, 3041 Parkwood Avenue, Windsor, Ontario, Canada, N8W 2K5

[21] Appl. No.: 308,531

[22] Filed: Feb. 10, 1989

[51] Int. Cl.[4] ..... F41C 23/00

[52] U.S. Cl. ..... 42/73; 42/74

[58] Field of Search ..... 42/73, 74

[56] References Cited

U.S. PATENT DOCUMENTS

| | | |
|---|---|---|
| 345,120 | 7/1886 | Cottrell . |
| 1,468,354 | 9/1923 | Caretto . |
| 1,480,350 | 1/1924 | Martin et al. . |
| 1,582,395 | 4/1926 | Haemmerli . |
| 2,066,218 | 12/1936 | Morgan . |
| 2,161,498 | 6/1939 | Anderson . |
| 2,187,548 | 1/1940 | Smith . |
| 2,453,394 | 11/1948 | Wittman . |
| 2,667,005 | 1/1954 | Weis . |
| 3,001,312 | 9/1951 | Campbell . |
| 3,388,494 | 6/1968 | Kimball . |

FOREIGN PATENT DOCUMENTS

| | | | |
|---|---|---|---|
| 109533 | 12/1907 | Canada . | |
| 156165 | 6/1914 | Canada . | |
| 173111 | 11/1916 | Canada . | |
| 177316 | 5/1917 | Canada . | |
| 217272 | 3/1922 | Canada . | |
| 546193 | 9/1957 | Canada . | |
| 829022 | 12/1969 | Canada . | |
| 206207 | 1/1984 | Fed. Rep. of Germany | 42/74 |

*Primary Examiner*—Charles T. Jordan
*Assistant Examiner*—Richard W. Wendtland
*Attorney, Agent, or Firm*—David L. Davis

[57] ABSTRACT

A gun butt for attachment to the stock of a firearm is disclosed. It includes a plate member to be secured to the firearm stock and a recoil pad including a base portion with means for adjustably securing the base portion to the plate member about several axes so as to provide a wide range of adjustment for the user of the firearm.

3 Claims, 1 Drawing Sheet

RECOIL PAD FOR RIFLE

FIELD OF THE INVENTION

The present invention relates to the structure of firearms, particularly to a recoil pad adapted to be mounted on the stock of a rifle.

BACKGROUND OF THE INVENTION

Adjustable recoil pads for rifle or shotgun butt plates are known. Canadian Pat. No. 546193 discloses an adjustable butt plate which is vertically movable in a slot extending on a complementary plate connected to the gun stock. The complementary plate is itself capable of extending outwardly from a further plate fixed to the stock.

U.S. Pat. No. 1,468,834 discloses a gun with a front stock section comprising the gun barrel and the firing mechanism and a rear stock section. Movement between the stock sections is provided by a ball and socket joint. This allows lateral movement of the stock sections in relation to each other.

U.S. Pat. No. 1,480,350 discloses an attachment for gun stocks comprising two adjustable members, wherein one member can be swung around a pivot with respect to the other member. The shoulder pad can be moved around the pivot and the pitch of the gun is varied through the rotation of two adjustment pins. This invention only provides for adjustment of the pad around an axis extending longitudinally through the stock of the gun.

U.S. Pat. No. 2,187,548 discloses an adjustable gun stock which allows the barrel pitch to be varied. The gun stock is comprised of a metal cap plate secured to the butt and a metal housing attached thereto. At the rear of the second housing is the shoulder rest section of the gun stock. The latter is adapted through the use of a clip and screw to be rocked around a transverse axis relative to the other sections. The shoulder rest section can also be adjusted vertically through the use of a screw.

SUMMARY OF THE INVENTION

The present invention provides a recoil pad which is both vertically and pivotally adjustable in relation to the butt plate of the firearm. This gives the rifle user a wide range of adjustable positions in which the rifle can be fitted to the user.

According to a broad aspect, the present invention relates to a gun butt for attachment to the stock of a fire arm. The gun butt comprises a generally flat plate member for attachment to the stock; a recoil pad having a combined base portion and pad portion thereon; means adjustably securing the base portion to the plate member adjacent the transverse center thereof; the base portion having the configuration of an extremely wide "V" from its transverse center towards its ends whereby the base portion is capable of a rocking movement on the surface of the plate about the adjustable securing means. Means are provided on the base portion for maintaining the ends thereof at a desired distance from the surface of the plate member. The adjustable securing means provides a longitudinal movement of the base portion along the longitudinal axis of the plate member and means are provided for pivotally adjusting the plate member to the fire arm stock.

BRIEF DESCRIPTION OF THE DRAWINGS

The invention is illustrated, by way of example in the accompanying drawings in which.

DESCRIPTION OF THE PREFERRED EMBODIMENT

Figure 2:
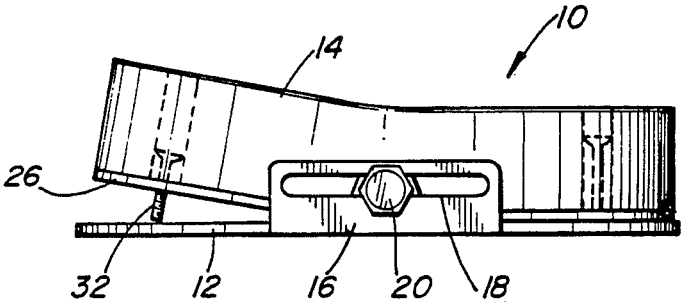
FIG. 2 is a side view of the assembled recoil pad.

Referring to the drawings, a recoil pad assembly indicated generally at 10 is adapted to be fixed to the stock of a firearm such as a rifle, not shown. The recoil pad assembly 10 comprises a plate 12 conforming in size and shape to that of the butt end of the rifle and is adapted to be fixed thereto. A shoulder rest portion 14 similar in plan configuration to the plate 12 is removably secured thereto as seen in FIG. 2.

The plate 12 is generally elliptical and the long side edges thereof are provided with two spaced, parallel flanges 16 each having an elongated slot 18 therein for receiving a tie bolt 20 which detachably secures the pad 14 to the plate 12.

One end of the plate is provided with an arcuate aperture 22, the other end having an aperture 24.

The shoulder rest and its associated base portion 26 has a slightly concave or wide V shape so that the rest 14 engages the shoulder of a person using the fire arm. The shoulder rest 14 also includes a metal base 26 which has an upwardly extending tab 28 located centrally on either side of the rest 14. An aperture 30 is provided through the tab 28 and the shoulder portion of the shoulder rest 14.

Screws 32 and 34 are adjusted in or out via apertures 33 in the pad 14. These screws are of such a length as to fall well short of the surface of the pad 14 so as to not bother the user of the fire arm. It will be appreciated that the screws 32 and 34 do not attach to the plate 12 in any way but simply make contact with the surface thereof and, when both screws do so, the base member 26 and the pad 14 are then stationary insofar as a rocking action is concerned between the base 26 and the plate 12. By relaxing the tension on tie bolt 20 by slacking off its nut, the base 26 and pad 14 can move longitudinally along the longitudinal axis of the plate 12 to the extent allowed by the length of the elongated slots 18 in the flanges 16 which limit the movement of the tie bolt 26 forward and aft. It will be understood that the longitudinal movement of the base portion 26 and the pad 14 can be carried out without changing the angle of the base 26 set by the screws 32 and 34 as they will simply slide along the upper surface of the plate.

Figure 1:
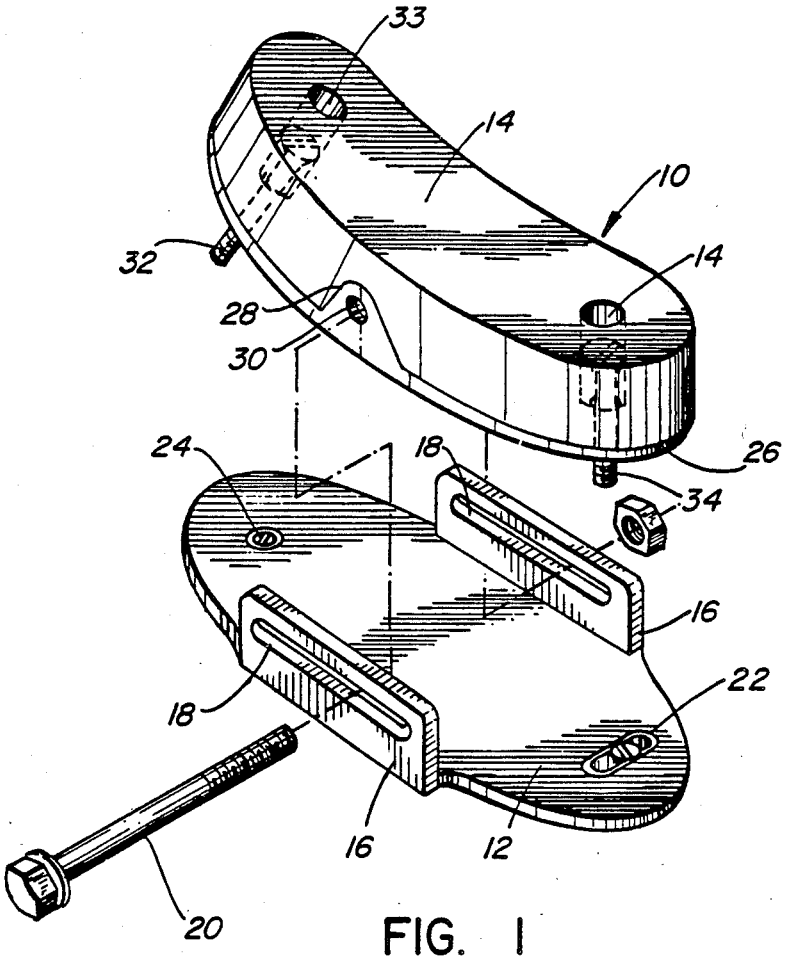
FIG. 1 is a disassembled view of the recoil pad.

Plate 12 is fastened to the gun stock through arcuate slot 22 and aperture 24 with suitable screws. The apertures are countersunk so that plate 12 is still flat one fastened to the gun stock. Plate 12 is intended to be secured to the stock and then finished around its peripheral edge to match the shape of the stock. It will be appreciated from FIG. 1 that slacking off the fastening screws in aperture 24 and arcuate slot 22 allows the plate 12 and the rest attached thereto to pivot on the end of the gun stock about aperture 24 and through the range of the width of the arcuate slot 22.

In operation, the shoulder rest 14 is connected to the plate 12 by inserting the bolt 20 through the slots 18 on the plate 12 and aperture 30 in the rest base 26. The shoulder rest 14 can be vertically adjusted in relation to the rifle by movement of the rest 14 and the tie bolt 20 in the elongated slots 18.

It will be understood that the gun butt is pivotally adjustable around the axis which extends through the aperture 30 in the base member 26 with the tie bolt 20 securing the desired position of the rest 14 about this axis via the adjusting screw means 32 and 34 which sets the various angles of the base 26 with respect to the plate 12. A further axis is obtainable by adjusting the position of plate 12 on the end of the rifle stock via the aperture 24 functioning as the pivot point and the desired position being obtained through the range of the arcuate slot 22. These two adjustments about these axes together with the available longitudinal movement of the rest 14 along the base plate 12 through the provision of the elongated slots 18 provides a gun butt of substantial adjustability.

While the present invention has been described in connection with the specific embodiment thereof and in the specific use, various modifications will occur to those skilled in the art without departing from the spirit and scope of the invention as set forth in the appended claims.

The terms and expressions used in this specification are used as terms of description and not of limitation and there is no intention in the use of such terms and expressions to exclude any equivalent of the features shown in the prescribed proportions thereof but it is recognized that various modifications are possible within the scope of the invention claim.

I claim:

1. A gun butt for attachment to the stock of a firearm, said butt comprising:

a generally flat plate member for securement to said stock;

a recoil pad having a combined base portion and pad portion thereon;

means adjustably securing said base portion to said plate member adjacent the transverse center thereof, said adjustable securing means comprising a pair of elongated, upstanding flange means, one on either side of said plate member, an elongated slot in each of said flange means, and a tie bolt extending transverse of said plate member and through said flange slots, said base portion being pivotally mounted on said tie bolt;

said base portion having the configuration of an extremely wide "V" from its transverse center toward its ends whereby said base portion is capable of a rocking movement on the surface of the plate member about said adjustable securing means;

means on said base portion for maintaining the ends thereof at a desired distance from the surface of said plate member;

said adjustable securing means providing longitudinal movement of said base portion along the longitudinal axis of said plate member; and means for pivotally adjusting said plate member to said firearm stock.

2. A gun butt according to claim 1 including stud means located in said base portion adjacent each end thereof and adjustable inward and outward of said base portion to space the ends thereof at a desired position relative to said plate member.

3. A gun butt according to claim 1 wherein the means for pivotally adjusting the plate member to said stock comprises an arcuate slot in said plate member adjacent one end thereof and an aperture adjacent the other end thereof; adjustable fastening means securing said plate member to said firearm stock through said aperture and said arcuate slot whereby one end of said plate member can pivot on the stock about said aperture and through the range of the width of the slot.

* * * * *